US009905246B2

(12) United States Patent
Jeong et al.

(10) Patent No.: US 9,905,246 B2
(45) Date of Patent: Feb. 27, 2018

(54) APPARATUS AND METHOD OF CREATING MULTILINGUAL AUDIO CONTENT BASED ON STEREO AUDIO SIGNAL

(71) Applicant: Electronics and Telecommunications Research Institute, Daejeon (KR)

(72) Inventors: Young Ho Jeong, Daejeon (KR); Tae Jin Lee, Daejeon (KR); Dae Young Jang, Daejeon (KR); Jin Soo Choi, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 15/400,755

(22) Filed: Jan. 6, 2017

(65) Prior Publication Data

US 2017/0251320 A1 Aug. 31, 2017

(30) Foreign Application Priority Data

Feb. 29, 2016 (KR) ..... 10-2016-0024431

(51) Int. Cl.

| | |
|---|---|
| ***H04R 5/00*** | (2006.01) |
| ***G10L 21/0332*** | (2013.01) |
| ***G10L 21/028*** | (2013.01) |

(52) U.S. Cl.

CPC ..... *G10L 21/0332* (2013.01); *G10L 21/028* (2013.01); *H04S 2400/15* (2013.01)

(58) Field of Classification Search

USPC ..... 381/1, 2, 17, 18, 26, 150, 19, 20, 59, 381/310, 300, 339; 704/2, 8, 9

See application file for complete search history.

(56) References Cited

U.S. PATENT DOCUMENTS

| | | | | |
|---|---|---|---|---|
| 8,111,830 | B2 | 2/2012 | Moon et al. | |
| 8,843,364 | B2 * | 9/2014 | Mysore | G10L 21/028 704/10 |
| 2005/0027522 | A1 * | 2/2005 | Yamamoto | G10L 15/20 704/233 |
| 2009/0034766 | A1 * | 2/2009 | Hamanaka | H04R 3/12 381/310 |
| 2009/0136048 | A1 | 5/2009 | Yoo et al. | |

(Continued)

OTHER PUBLICATIONS

Dan Barry et al., "Sound Source Separation: Azimuth Discrimination and Resynthesis", Proceedings of the 7th. International Conference on Digital Audio Effects (DAFX 04), Oct. 5-8, 2004, pp. 1-5, Napes, Italy.

*Primary Examiner* — Yosef K Laekemariam

(57) ABSTRACT

Provided is an apparatus and method for creating multilingual audio content based on a stereo audio signal. The method of creating multilingual audio content including adjusting an energy value of each of a plurality of sound sources provided in multiple languages, setting an initial azimuth angle of each of the sound sources based on a number of the sound sources, mixing each of the sound sources to generate a stereo signal based on the set initial azimuth angle, separating the sound sources to play the mixed sound sources using a sound source separating algorithm, and storing the mixed sound sources based on a sound quality of each of the separated sound sources.

13 Claims, 6 Drawing Sheets

(56) References Cited

U.S. PATENT DOCUMENTS

| | | | | |
|---|---|---|---|---|
| 2011/0246172 | A1* | 10/2011 | Liberman | G06F 17/289<br>704/2 |
| 2012/0095729 | A1 | 4/2012 | Kim et al. | |
| 2015/0271618 | A1 | 9/2015 | Kim et al. | |

* cited by examiner

| | | SIR | SDR | SAR |
|---|---|---|---|---|
| Case 1 | Left sound source S1 | 25.19 | 4.34 | 4.39 |
| | Right sound source S2 | 22.68 | 9.24 | 9.47 |
| | Center sound source S3 | 24.50 | 9.96 | 10.13 |
| Case 2 | Left sound source S1 | 24.96 | 4.55 | 4.60 |
| | Right sound source S2 | 22.63 | 9.27 | 9.49 |
| | Center sound source S3 | 24.81 | 7.57 | 7.67 |

APPARATUS AND METHOD OF CREATING MULTILINGUAL AUDIO CONTENT BASED ON STEREO AUDIO SIGNAL

CROSS-REFERENCE TO RELATED APPLICATION(S)

This application claims the priority benefit of Korean Patent Application No. 10-2016-0024431 filed on Feb. 29, 2016, in the Korean Intellectual Property Office, the disclosure of which is incorporated herein by reference for all purposes.

BACKGROUND

1. Field

One or more example embodiments relate to an apparatus for creating and a method of creating multilingual audio content based on a stereo audio signal, and more particularly, to an apparatus for providing and a method of providing a multilingual audio service based on a left stereo audio signal and a right stereo audio signal.

2. Description of Related Art

In the early 1930s, people started to recognize a sense of space that can be provided by a sound source which cannot be felt from a mono signal after Alan Dower Blumlein embodied an idea related to a stereo audio system. After long-playing (LP) records appeared in the late 1940s and compact disks (CDs) appeared in the early 1980s, a content market related to stereo music continued to develop and continues to develop in the 2000s as a result of popularization of cloud/streaming services and personal devices, for example, an MPEG audio layer 3 (MP3) player, a smartphone, and a smartpad.

The stereo audio content currently consumed by users is mainly associated with various genres of music such as classical, pop, jazz, and ballad. The stereo audio content may be created by mixing sound sources of various instruments and voices recorded in studios or from performance scenes. In order for the sense of space to be provided by the sound source, a panning effect may be applied to a stereo signal. The panning effect may use a human auditory characteristic for identifying a location of the sound source based on an interaural intensity difference (IID) between audio signals input to a left ear and a right ear.

Recently, with appearances of global content platform companies such as Google, Apple, Amazon, and Netflix, a multilingual dubbing service to provide dubbing in a language of a corresponding country for localization of content has been receiving attention. Since many countries around the world including Korea have become multicultural and multiracial, the multilingual dubbing service for video content should be supported in many countries. A new content platform, for example, Podcast, that provides audio content only may be required to support the multilingual dubbing service for audio content for a requested location, for globalization.

Most multilingual audio services allocate one audio channel for each language, which wastes storage and network resources because multiple audio channel content is transmitted and stored. To solve such problems, the present disclosure proposes a method of effectively providing a multilingual audio service using a stereo signal.

SUMMARY

An aspect provides an apparatus for creating and a method of creating multilingual audio content to reduce a volume of a storage and a network by providing a multilingual audio service based on a left stereo audio signal and a right stereo audio signal.

According to an aspect, there is provided a method of creating multilingual audio content, the method including adjusting an energy value of each of a plurality of sound sources provided in multiple languages, setting an initial azimuth angle of each of the sound sources based on a number of the sound sources, mixing each of the sound sources to generate a stereo signal based on the set initial azimuth angle, separating the sound sources to play the mixed sound sources using a sound source separating algorithm, and storing the mixed sound sources based on a sound quality of each of the separated sound sources.

The method may further include evaluating the sound quality of each of the separated sound sources, wherein the storing may include storing the mixed sound sources based on the evaluated sound quality of each of the separated sound sources.

The evaluating may include evaluating the sound quality of each of the sound sources based on at least one of source to artifact ratio (SAR) information, source to distortion ratio (SDR) information, and source to interference ratio (SIR) information of each of the separated sound sources.

The evaluating may include adjusting a signal intensity and the initial azimuth angle of each of the sound sources when at least one of the SAR information, the SDR information, and the SIR information of each of the sound sources is less than a preset threshold value.

The adjusting may include verifying the energy value of each of the sound sources and adjusting the energy value to be a maximum value among the verified energy values.

The mixing may include calculating a signal intensity ratio of a left signal and a right signal of each of the sound sources based on the initial azimuth angle of each of the sound sources, determining a left signal component and a right signal component of each of the sound sources to be mixed to generate a left stereo signal and a right stereo signal based on the calculated signal intensity ratio, and generating the left stereo signal and the right stereo signal by mixing the determined left signal component and the right signal component of each of the sound sources.

The storing may further include adding additional information on each of the mixed sound sources, and the additional information includes at least one of signal intensity information, azimuth angle information, and language information of each of the mixed sound sources.

According to another aspect, there is provided an apparatus for creating multilingual audio content, the apparatus including an adjuster configured to adjust an energy value of each of a plurality of sound sources provided in multiple languages, a setter configured to set an initial azimuth angle of each of the sound sources based on a number of the sound sources, a mixer configured to mix each of the sound sources to generate a stereo signal based on the set initial azimuth angle, a separator configured to separate the sound sources to play the mixed sound sources using a sound source separating algorithm, and a storage configured to store the mixed sound sources based on a sound quality of each of the separated sound sources.

The apparatus may further include an evaluator configured to evaluate the sound quality of each of the separated sound sources, wherein the storage may be configured to store the mixed sound sources based on the evaluated sound quality of each of the sound sources.

The evaluator may be configured to evaluate the sound sources based on at least one of source to artifact ratio (SAR)

information, source to distortion ratio (SDR) information, and source to interference ratio (SIR) information of each of the separated sound sources.

The evaluator may be configured to define the SAR information, the SDR information, and the SIR information by analyzing a component of each of the separated sound sources.

According to still another aspect, there is provided a method of playing multilingual audio content, the method including receiving multilingual audio content, outputting a stereo signal included in the received multilingual audio content, providing, for a user, language information of each of a plurality of sound sources among pieces of additional information on the sound sources included in the output stereo signal, and separating a sound source corresponding to the language information selected by the user from the sound sources included in the output stereo signal using a sound source separating algorithm.

The additional information may include at least one of signal intensity information, azimuth angle information, and language information of each of the sound sources included in the output stereo signal.

According to yet another aspect, there is provided an apparatus for playing multilingual audio content, the apparatus including a receiver configured to receive multilingual audio content, an outputter configured to output a stereo signal included in the received multilingual audio content, a provider configured to provide, for a user, language information of each of a plurality of sound sources among pieces of additional information on the sound sources included in the output stereo signal, a separator configured to separate a sound source corresponding to the language information selected by the user from the sound sources included in the output stereo signal using a sound source separating algorithm, and a player configured to play the separated sound sources.

The additional information may include at least one of signal intensity information, azimuth angle information, and language information of each of the sound sources included in the output stereo signal.

Additional aspects of example embodiments will be set forth in part in the description which follows and, in part, will be apparent from the description, or may be learned by practice of the disclosure.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
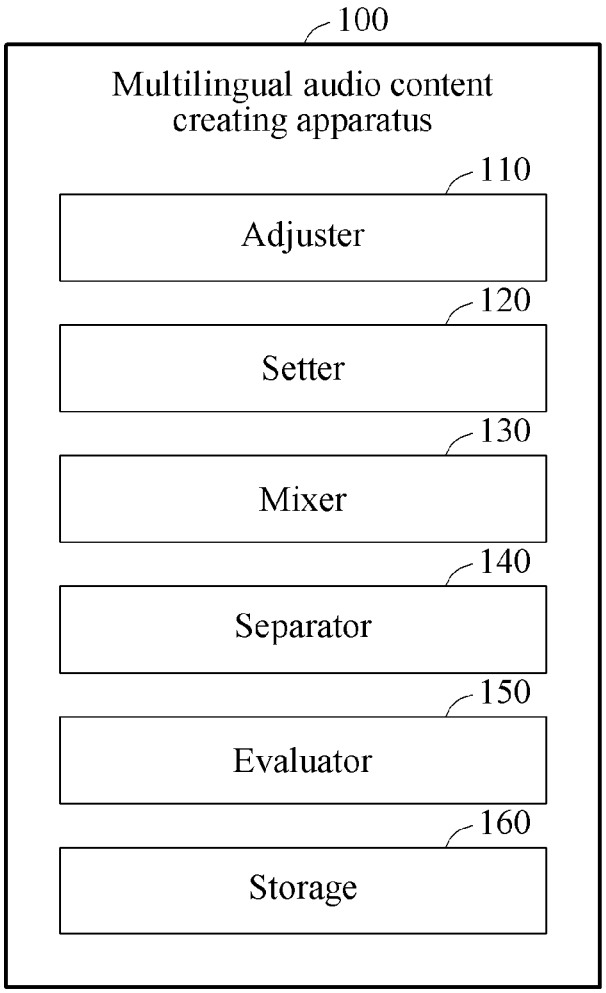
FIG. 1 is a block diagram illustrating an apparatus for creating multilingual audio content according to an example embodiment.

Hereinafter, some example embodiments will be described in detail reference to the accompanying drawings. Regarding the reference numerals assigned to the elements in the drawings, it should be noted that the same elements will be designated by the same reference numerals, wherever possible, even though they are shown in different drawings. Also, in the description of embodiments, detailed description of well-known related structures or functions will be omitted when it is deemed that such description will cause ambiguous interpretation of the present disclosure.

It should be understood, however, that there is no intent to limit this disclosure to the particular example embodiments disclosed. On the contrary, example embodiments are to cover all modifications, equivalents, and alternatives falling within the scope of the example embodiments. Like numbers refer to like elements throughout the description of the figures.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The terminology used herein is for the purpose of describing particular embodiments only and is not intended to be limiting. As used herein, the singular forms "a," "an," and "the," are intended to include the plural forms as well, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Various example embodiments will now be described more fully with reference to the accompanying drawings in which some example embodiments are shown. In the drawings, the thicknesses of layers and regions are exaggerated for clarity.

FIG. 1 is a block diagram illustrating an apparatus for creating multilingual audio content according to an example embodiment.

An apparatus for creating multilingual audio content, hereinafter referred to as a multilingual audio content creating apparatus 100, includes an adjuster 110, a setter 120, a mixer 130, a separator 140, an evaluator 150, and a storage 160.

The adjuster 110 adjusts an energy value of each of a plurality of sound sources provided in multiple languages. The adjuster 110 may perform energy normalization on each of the sound sources to be input to reduce distortions occurring when separated sound sources are combined or an azimuth angle of each of the sound sources is extracted in a process in which the multilingual audio content is played.

The setter 120 sets a signal intensity and an initial azimuth angle of each of the sound sources based on a number of sound sources. The setter 120 may set the initial azimuth angle of each of the sound sources such that a difference between azimuth angles of the sound sources is greatest. The signal intensity of each of the sound sources may be set to be 1.

The mixer 130 mixes each of the sound sources to generate a stereo signal based on the set signal intensity and the initial azimuth angle. The mixer 130 calculates a signal intensity ratio of a left signal and a right signal of each of the sound sources based on the initial azimuth angle of each of the sound sources and determines a left signal component and a right signal component of each of the sound sources to be mixed to generate a left stereo signal and a right stereo signal based on the calculated signal intensity ratio. Subsequently, the mixer 130 generates the left stereo signal and the right stereo signal by mixing the determined left signal component and the right signal component of each of the sound sources.

The separator 140 separates the sound sources to play the mixed sound sources using a sound source separating algorithm.

The evaluator 150 evaluates a sound quality of each of the separated sound sources. The evaluator 150 may use an objective evaluation index for evaluating the sound quality of each of the sound sources. The evaluator 140 may use at least one of source to artifact ratio (SAR) information, source to distortion ratio (SDR) information, and source to interference ratio (SIR) information of each of the sound sources separated based on the objective evaluation index.

The evaluator 150 adjusts the signal intensity and the azimuth angle of each of the sound sources when at least one of the SAR information, the SDR information, and the SIR information of each of the sound sources is less than a preset threshold value. The mixer 130 mixes the sound sources to generate the stereo signal based on the adjusted signal intensity and the azimuth angle.

The storage 160 stores the stereo signal generated by mixing the sound sources based on the evaluated sound quality of each of the sound sources. The stereo signal may be stored based on a related audio file format, and the stereo signal may include additional information including detailed information of each of the sound sources included in the stereo signal.

Figure 2:
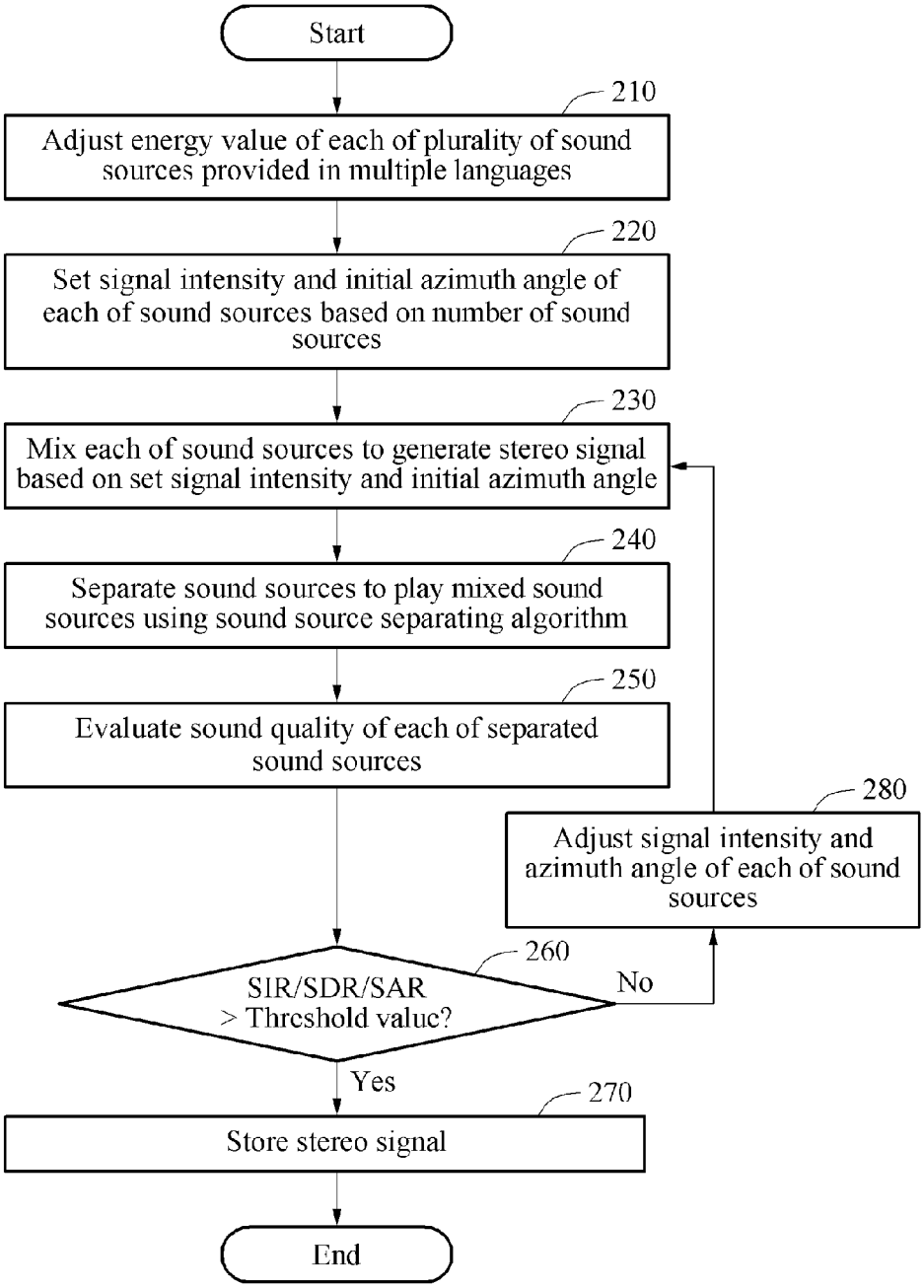
FIG. 2 is a flowchart illustrating a method of creating multilingual audio content according to an example embodiment.

FIG. 2 is a flowchart illustrating a method of creating multilingual audio content according to an example embodiment.

In operation 210, the multilingual audio content creating apparatus 100 adjusts an energy value of each of a plurality of sound sources provided in multiple languages. The multilingual audio content creating apparatus 100 may perform energy normalization on each of the sound sources to be input to reduce distortions occurring when separated sound sources are combined or an azimuth angle of each of the sound sources is extracted in a process in which the multilingual audio content is played.

The multilingual audio content creating apparatus 100 may compare energy values of the sound sources and then adjust the energy value of each of all sound sources to be a maximum value among the energy values.

In operation 220, the multilingual audio content creating apparatus 100 sets a signal intensity and the initial azimuth angle of each of the sound sources based on a number of the sound sources. The multilingual audio content creating apparatus 100 may set the initial azimuth angle of each of the sound sources such that a difference between azimuth angles of the sound sources is greatest. The signal intensity of each of the sound sources may be set to be 1.

For example, when the number of the sound sources corresponds to 3, the multilingual audio content creating apparatus 100 firstly sets azimuth angles of two sound sources to be on a left side (an azimuth angle of 0°) and a right side (an azimuth angle of 180°) within a range of 0° to 180° such that the difference between the azimuth angles of the sound sources is greatest. Subsequently, the multilingual audio content creating apparatus 100 may set the initial azimuth angle such that the difference between the azimuth angles between the sound sources is greatest by setting the other one sound source to be at a center (an azimuth angle of 90°).

When the number of the sound sources corresponds to 4, the multilingual audio content creating apparatus 100 firstly sets azimuth angles of two sound sources to be on the left side (the azimuth angle of 0°) and the right side (the azimuth angle of 180°) within the range of 0° to 180° such that the difference between the azimuth angles of the sound sources is greatest. Subsequently, the multilingual audio content creating apparatus 100 may set the initial azimuth angle such that the difference between the azimuth angles between the sound sources is greatest by setting the other two sound sources to be at an azimuth angle of 60° and an azimuth angle of 120°, respectively.

In operation 230, the multilingual audio content creating apparatus 100 mixes each of the sound sources to generate a stereo signal based on the set signal intensity and the initial azimuth angle. The multilingual audio content creating apparatus 100 may calculate a signal intensity ratio g(i) of a loft signal and a right signal of each of the sound sources based on the initial azimuth angle of each of the sound sources, as shown in Equation 1.

$$g(i) = \begin{cases} \tan\left(\frac{\theta_i \cdot \pi}{360°}\right), & \text{if } \theta_i \le 90° \\ \tan\left(\frac{(180° - \theta_i) \cdot \pi}{360°}\right), & \text{if } \theta_i > 90° \end{cases} \quad \text{[Equation 1]}$$

Here, $\theta_i$ denotes an azimuth angle of an i-th sound source $x_i(t)$ and may indicate an integer in a range of $0° < \theta_i \le 90°$.

Subsequently, the multilingual audio content creating apparatus 100 may determine a left signal component $x_{iL}(t)$ and a right signal component $x_{iR}(t)$ of each of the sound sources to be mixed to generate a left stereo signal $S_L(t)$ and a right stereo signal $S_R(t)$ based on the calculated signal intensity ratio g(i), as shown in Equation 2.

$$\begin{cases} x_{iL}(t) = g(i) \cdot x_{iR}(t), & \text{if } \theta_i < 90°, \text{ (where, } x_{iL}(t) = x_i(t)) \\ x_{iR}(t) = x_{iL}(t), & \text{if } \theta_i = 90°, \text{ (where, } x_{iR}(t) = 0.5 \cdot x_i(t)) \\ x_{iR}(t) = g(i) \cdot x_{iL}(t), & \text{if } \theta_i > 90°, \text{ (where, } x_{iR}(t) = x_i(t)) \end{cases} \quad \text{[Equation 2]}$$

As shown in Equation 3, the multilingual audio content creating apparatus 100 generates the left stereo signal $S_L(t)$ and the right stereo signal $S_R(t)$ by combining the left signal component $x_{iL}(t)$ and the right signal component $x_{iR}(t)$ of each of the sound sources determined using Equation 2.

$$\begin{cases} S_L(t) = \sum_{i=1}^{N} x_{iL}(t) \\ S_R(t) = \sum_{i=1}^{N} x_{iR}(t) \end{cases} \quad \text{[Equation 3]}$$

In operation 240, the multilingual audio content creating apparatus 100 separates the sound sources to play the mixed sound sources using a sound source separating algorithm.

In operation 250, the multilingual audio content creating apparatus 100 evaluates a sound quality of each of the separated sound sources. The multilingual audio content creating apparatus 100 may use an objective evaluation index for evaluating the sound quality of each of the sound sources. The multilingual audio content creating apparatus 100 may use at least one of source to artifact ratio (SAR) information, source to distortion ratio (SDR) information, and source to interference ratio (SIR) information of each of the sound sources separated based on the objective evaluation index.

As shown in Equation 4, the objective evaluation index may be defined by analyzing a component of a separation sound source $\hat{s}(t)$ separated in operation 240.

$$\hat{s}(t)=s_{target}(t)+e_{interf}(t)+e_{noise}(t)+e_{artif}(t) \quad \text{[Equation 4]}$$

The multilingual audio content creating apparatus 100 may define the SIR information, the SDR information, and the SAR information as shown in Equations 5 through 7 using the component of the separation sound source $\hat{s}(t)$ separated using Equation 4.

$$SIR = 10\log_{10}\frac{\|s_{target}\|^2}{\|e_{interf}\|^2} \quad \text{[Equation 5]}$$

$$SDR = 10\log_{10}\frac{\|s_{target}\|^2}{\|e_{interf}+e_{noise}+e_{artif}\|^2} \quad \text{[Equation 6]}$$

$$SAR = 10\log_{10}\frac{\|s_{target}+e_{interf}+e_{noise}\|^2}{\|e_{artif}\|^2} \quad \text{[Equation 7]}$$

When the objective evaluation index defined in operation 250 is less than a preset threshold value in operation 260, the multilingual audio content creating apparatus 100 adjusts the signal intensity and the azimuth angle of each of the sound sources in operation 280. Subsequently, the multilingual audio content creating apparatus 100 may generate the new left stereo signal $S_L(t)$ and the right stereo signal $S_R(t)$ and evaluate the sound quality of each of the sound sources by separating the sound sources. The multilingual audio content creating apparatus 100 may repeatedly perform operations 230 through 260 until the objective evaluation index of each of the sound sources is greater than or equal to the preset threshold.

In operation 270, the multilingual audio content creating apparatus 100 may finish creating stereo audio content for providing a multilingual audio service by storing a stereo signal generated by mixing the sound sources when the evaluated sound quality of each of the sound sources satisfies the preset threshold. The stereo signal may be stored based on a related audio file format, and the stereo signal may include additional information including detailed information of each of the sound sources included in the stereo signal.

Figure 3:
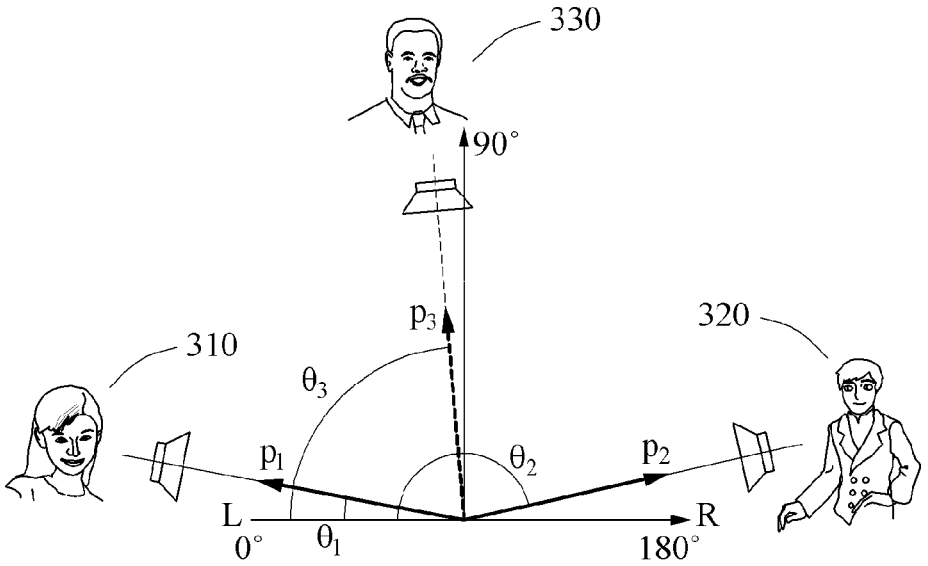
FIG. 3 is a diagram illustrating a method of adjusting a signal intensity and an azimuth angle of a sound source according to an example embodiment.

FIG. 3 is a diagram illustrating a method of adjusting a signal intensity and an azimuth angle of a sound source according to an example embodiment.

When predetermined frequency components of sound sources have similar values in a spectrum space, the predetermined frequency components may exert a negative influence on a sound quality of each of separated sound sources. Thus, the multilingual audio content creating apparatus 100 may adjust a signal intensity and an azimuth angle of each of the sound sources in order to reduce the negative influence by the predetermined frequency components.

For example, when at least two sound sources are combined, a common partial component may be generated in a space of azimuth angles. The multilingual audio content creating apparatus 100 may control a location of the common partial component of the sound sources by adjusting an azimuth angle of each of the sound sources.

When a plurality of signal components is present in an identical spectrum, the signal components may cause mutual interferences. Thus, the multilingual audio content creating apparatus 100 may reduce the mutual interferences by adjusting the signal intensity of each of the sound sources.

The multilingual audio content creating apparatus 100 may adjust the signal intensity and the azimuth angle of each of all sound sources as illustrated in FIG. 3. The multilingual audio content creating apparatus 100 may fix a signal intensity and an azimuth angle of a sound source 310 provided from a left side and a signal intensity and an azimuth angle of a sound source 320 provided from a right side, and adjust a signal intensity and an azimuth angle of a sound source 330 provided from a center.

The multilingual audio content creating apparatus 100 may recalculate the signal intensity ratio g(i) of a left signal and a right signal corresponding to the azimuth angle using Equation 1 based on a condition of an adjusted azimuth angle $\theta_i$ of each of the sound sources. Subsequently, the multilingual audio content creating apparatus 100 may determine the left signal component $x_{iL}(t)$ and the right signal component $x_{iR}(t)$ of each of the sound sources to be mixed to generate the left stereo signal $S_L(t)$ and the right stereo signal $S_R(t)$ using Equation 8 to which a value $\alpha_i$ of the adjusted signal intensity is applied.

[Equation 8]

$$\begin{cases} x_{iL}(t) = g(i)\cdot x_{iR}(t), & \text{if } \theta_i < 90°, \text{(where, } x_{iL}(t) = \alpha_i \cdot x_i(t)) \\ x_{iR}(t) = x_{iL}(t), & \text{if } \theta_i = 90°, \text{(where, } x_{iR}(t) = \alpha_i \cdot 0.5 \cdot x_i(t)) \\ x_{iR}(t) = g(i)\cdot x_{iL}(t), & \text{if } \theta_i > 90°, \text{(where, } x_{iR}(t) = \alpha_i \cdot x_i(t)) \end{cases} \quad (8)$$

Subsequently, the multilingual audio content creating apparatus 100 may perform a sound source mixing process that generates the left stereo signal $S_L(t)$ and the right stereo signal $S_R(t)$ using the left signal component $x_{iL}(t)$ and the right signal component $x_{iR}(t)$ of each of the sound sources.

Figure 4A:
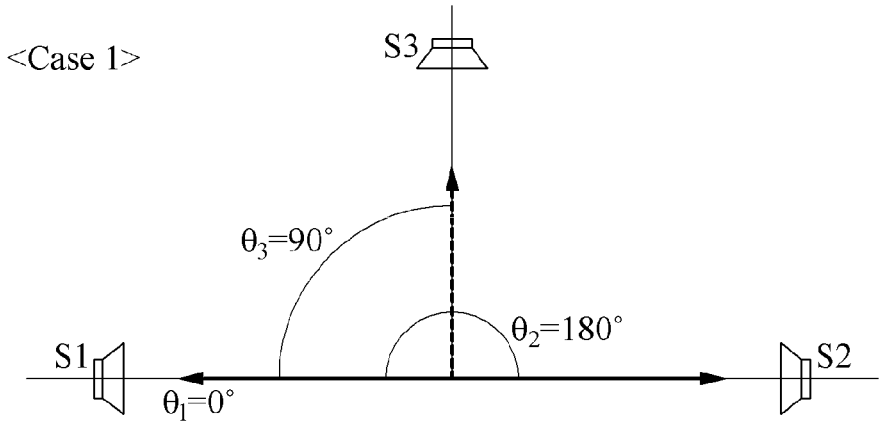
FIGS. 4A through 4C illustrate examples of a configuration of a stereo audio signal of an audio sound source provided in three languages and an objective result of performance evaluation based on the configuration according to an example embodiment.
Figures 4B, 4C:
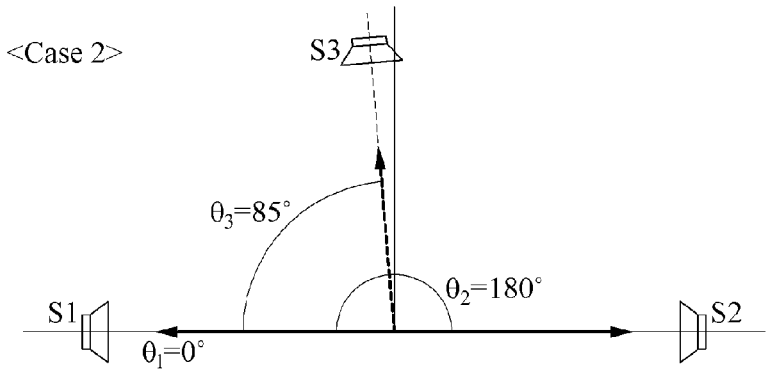

FIGS. 4A through 4C illustrate examples of a configuration of a stereo audio signal of an audio sound source provided in three languages and an objective result of performance evaluation based on the configuration according to an example embodiment.

FIGS. 4A and 4B illustrate examples of signal intensities and azimuth angles of sound sources provided in multiple languages. FIG. 4A shows a mixed signal obtained by setting the azimuth angles of sound sources provided in three languages to be on a left side (an azimuth angle of 0°), a right side (an azimuth angle of 180°), and at a center (an azimuth angle of 90°). Referring to FIG. 4B, the azimuth angle of the sound source on the right side and the azimuth angle of the sound source on the left side are maintained, the azimuth angle of the sound source at the center is changed to be 85°, and a value $\alpha_i$ of the signal intensity is set to be 1.

Referring to FIG. 4C, source to artifact ratio (SAR) information, source to distortion ratio (SDR) information, and source to interference ratio (SIR) information corresponding to an objective evaluation index for the performance evaluation are changed by adjusting the signal intensity and the azimuth angle of each of the sound sources. The SAR information, the SDR information, and the SIR information of the sound sources in a case 1 are similar to the SAR information, the SDR information, and the SIR information of the sound sources in a case 2, because the azimuth angles of the right side and the left side are maintained. However, the SAR information, the SDR information, and the SIR information of the sound sources in the case 1 are different from the SAR information, the SDR information, and the SIR information of the sound sources in the case 2, because the azimuth angle of the center is changed.

Figure 5:
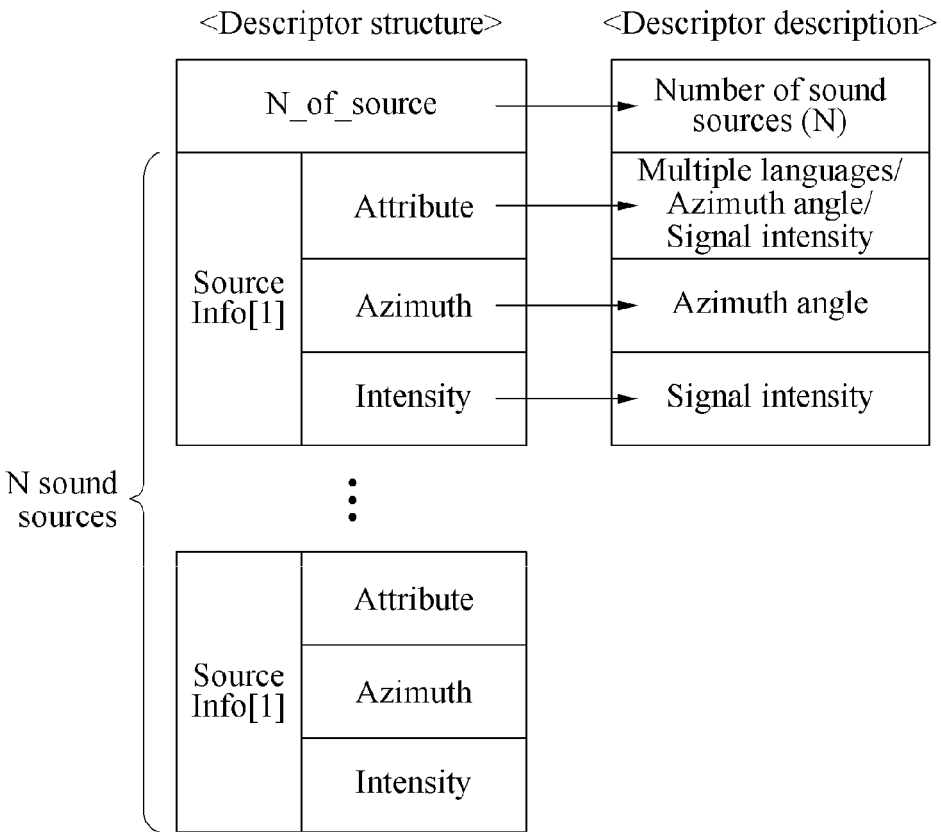
FIG. 5 is a diagram illustrating a configuration of additional information for a multilingual audio service according to an example embodiment.

FIG. 5 is a diagram illustrating a configuration of additional information for a multilingual audio service according to an example embodiment.

The multilingual audio content creating apparatus 100 may create stereo audio content for providing a multilingual audio service. A stereo signal may be stored based on a related audio file format, and the stereo signal may include additional information including detailed information of each of a plurality of sound sources included in the stereo signal.

The additional information included in the stereo audio content may include a number of sound sources provided in multiple languages, an attribute, an azimuth angle, and a signal intensity corresponding to the detailed information of each of the sound sources.

When the additional information is applied to general music content other than the multilingual audio service content, a field corresponding to an attribute of a language may include information on a voice or an instrument corresponding to attribute information of the sound source. By using the additional information, a number of operations for separating the sound sources may be decreased and an intuitive user interface (UI) may be provided for a user.

Figure 6:
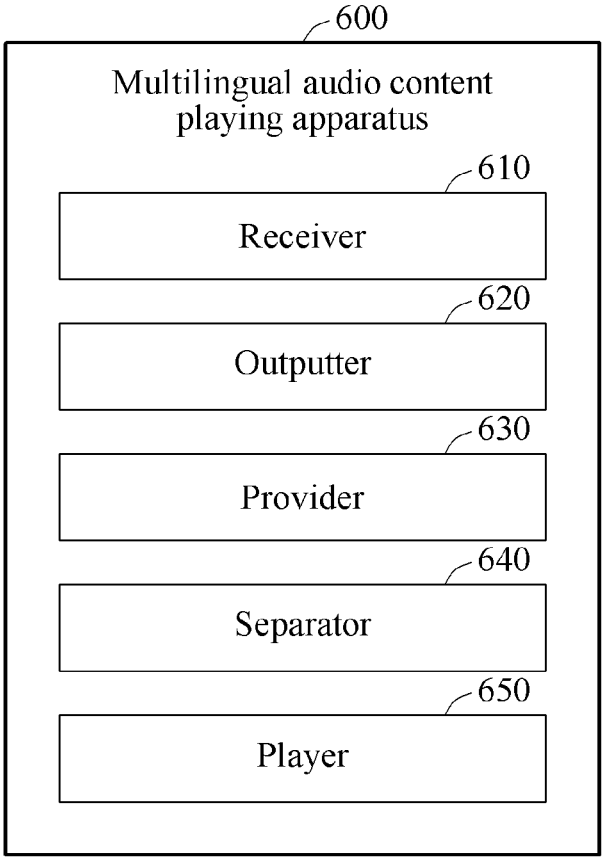
FIG. 6 is a block diagram illustrating an apparatus for playing multilingual audio content according to an example embodiment.

FIG. 6 is a block diagram illustrating an apparatus for playing multilingual audio content according to an example embodiment.

An apparatus for providing multilingual audio content, hereinafter referred to as a multilingual audio content playing apparatus 600, includes a receiver 610, an outputter 620, a provider 630, a separator 640, and a player 650. The receiver 610 receives multilingual audio content. The received multilingual audio content may include a stereo signal generated by mixing a plurality of sound sources corresponding to multiple languages.

The outputter 620 outputs the stereo signal included in the received multilingual audio content. The output stereo signal may include additional information on the sound sources corresponding to the multiple languages. The additional information may include at least one of signal intensity information, azimuth angle information, and language information of each of the sound sources included in the output stereo signal.

The provider 630 provides, for a user, the additional information on each of the sound sources included in the output stereo signal. The provider 630 may provide the language information of each of the sound sources for the user by performing parsing on the additional information on each of the sound sources included in the stereo signal.

The separator 640 separates a sound source corresponding to the language information selected by the user from the sound sources included in the stereo signal using a sound source separating algorithm. The separator 640 may separate the sound source corresponding to the language information selected by the user from the sound sources based on the azimuth angle information and the signal intensity information of each of the sound sources included in the additional information.

When the additional information is not included in the multilingual audio content including the stereo signal, the multilingual audio content playing apparatus 600 may separate the sound source included in the stereo signal from the sound sources, and then generate a list of the separated sound sources. The generated list may be provided for the user. Subsequently, the multilingual audio content playing apparatus 600 may output the sound source selected, by the user, from among the separated sound sources.

The player 650 plays the sound source corresponding to the language information selected, by the user, from among the sound sources included in the stereo signal.

According to an aspect, it is possible to reduce waste of storage and network resources by providing a multilingual audio service based on a left stereo audio signal and a right audio signal.

The components described in the exemplary embodiments of the present invention may be achieved by hardware components including at least one DSP (Digital Signal Processor), a processor, a controller, an ASIC (Application Specific Integrated Circuit), a programmable logic element such as an FPGA (Field Programmable Gate Array), other electronic devices, and combinations thereof. At least some of the functions or the processes described in the exemplary embodiments of the present invention may be achieved by software, and the software may be recorded on a recording medium. The components, the functions, and the processes described in the exemplary embodiments of the present invention may be achieved by a combination of hardware and software.

The units described herein may be implemented using hardware components, software components, or a combination thereof. For example, a processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such a parallel processors.

The software may include a computer program, a piece of code, an instruction, or some combination thereof, to independently or collectively instruct or configure the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. The software and data may be stored by one or more non-transitory computer readable recording mediums.

The method according to the above-described embodiments of the present invention may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the embodiments, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments of the present invention, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description but by the claims and their equivalents, and all variations within the scope of the claims and their equivalents are to be construed as being included in the disclosure.

What is claimed is:

1. A method of creating multilingual audio content, the method comprising:

adjusting a respective energy value of each of a plurality of sound sources, each of the sound sources being provided in a different language from the other sound sources;

setting a different respective initial azimuth angle for each of the sound sources based on a total number of sound sources present in the plurality of sound sources;

mixing each of the sound sources to generate a stereo signal using each respective set initial azimuth angle;

separating the sound sources to play the mixed sound sources using a sound source separating algorithm; and storing the mixed sound sources based on a sound quality of each of the separated sound sources.

2. The method of claim 1, further comprising:

evaluating the sound quality of each of the separated sound sources, wherein the storing comprises storing the mixed sound sources based on the evaluated sound quality of each of the separated sound sources.

3. The method of claim 2, wherein the evaluating comprises evaluating the sound quality of each of the sound sources based on at least one of source to artifact ratio (SAR) information, source to distortion ratio (SDR) information, and source to interference ratio (SIR) information of each of the separated sound sources.

4. The method of claim 3, wherein the evaluating comprises adjusting a signal intensity and the initial azimuth angle of each of the sound sources when at least one of the SAR information, the SDR information, and the SIR information of each of the sound sources is less than a preset threshold value.

5. The method of claim 1, wherein the adjusting comprises verifying the energy value of each of the sound sources and adjusting the energy value to be a maximum value among the verified energy values.

6. The method of claim 1, wherein the mixing comprises:

calculating a signal intensity ratio of a left signal and a right signal of each of the sound sources based on the initial azimuth angle of each of the sound sources;

determining a left signal component and a right signal component of each of the sound sources to be mixed to generate a left stereo signal and a right stereo signal based on the calculated signal intensity ratio; and generating the left stereo signal and the right stereo signal by mixing the determined left signal component and the right signal component of each of the sound sources.

7. The method of claim 1, wherein the storing further comprises adding additional information on each of the mixed sound sources, and the additional information includes at least one of signal intensity information, azimuth angle information, and language information of each of the mixed sound sources.

8. An apparatus for creating multilingual audio content, the apparatus comprising:

an adjuster configured to adjust a respective energy value of each of a plurality of sound sources, each of the sound sources being provided in a different language from the other sound sources;

a setter configured to set a different respective initial azimuth angle for each of the sound sources based on a total number of sound sources present in the plurality of sound sources;

a mixer configured to mix each of the sound sources to generate a stereo signal using each respective set initial azimuth angle;

a separator configured to separate the sound sources to play the mixed sound sources using a sound source separating algorithm; and a storage configured to store the mixed sound sources based on a sound quality of each of the separated sound sources.

9. The apparatus of claim 8, further comprising:

an evaluator configured to evaluate the sound quality of each of the separated sound sources, wherein the storage is configured to store the mixed sound sources based on the evaluated sound quality of each of the sound sources.

10. The apparatus of claim 9, wherein the evaluator is configured to evaluate the sound sources based on at least one of source to artifact ratio (SAR) information, source to distortion ratio (SDR) information, and source to interference ratio (SIR) information of each of the separated sound sources.

11. The apparatus of claim 10, wherein the evaluator is configured to define the SAR information, the SDR information, and the SIR information by analyzing a component of each of the separated sound sources.

12. A method of playing multilingual audio content, the method comprising:

receiving multilingual audio content comprising a plurality of sound sources in different respective languages each mixed into a single stereo signal at different respective azimuth angles;

outputting a stereo signal included in the received multilingual audio content;

providing, for a user, language information of each of a plurality of sound sources among pieces of additional information on the sound sources included in the output stereo signal;

separating a sound source corresponding to the language information selected by the user from the sound sources included in the output stereo signal using a sound source separating algorithm.

13. The method of claim 12, wherein the additional information includes at least one of signal intensity information, azimuth angle information, and language information of each of the sound sources included in the output stereo signal.

* * * * *